United States Patent [19]

Sosonkin et al.

[11] 4,107,449

[45] Aug. 15, 1978

[54] WATER-COOLED ROOF OF ELECTRIC-ARC FURNACE

[76] Inventors: Oleg Mikhailovich Sosonkin, ulitsa Chaikovskogo, 11, kv. 18; Leonid Savvich Katsevich, Sirenevy bulvar, 47, kv. 69, both of Moscow; Nikolai Alexeevich Pirogov, prospekt Lenina, 29, kv. 21, Elektrostal Moskovskoi oblasti; Zoya Mikhailovna Chistyakova, ulitsa Novocheremushkinskaya, 38, korpus 1, kv. 71; Viktor Alexandrovich Kudrin, ulitsa Krasnokazarmennaya, 12, korpus 1, kv. 32, both of Moscow; Jury Tikhonovich Borisov, Juzhny proezd, 3, kv. 30, Balashikha Moskovskoi oblasti; Oleg Evgenievich Molchanov, ploschad Metallurgov, 15, kv. 14, Cherepovets Volgogradskoi oblasti; Mikhail Vasilievich Savvin, ulitsa Kosmonavtov, 58, kv. 24, Lipetsk; Eduard Maximovich Grigoriev, poselok Remmash, 13, kv. 8, Zagorsk Moskovskoi oblasti; Alexei Ivanovich Fedchenko, ulitsa Michurina, 55, kv. 60; Anatoly Zakharovich Shevtsov, ulitsa Novaya, 149a, kv. 51, both of Krasnoyarsk; Valentin Semenovich Kudryavtsev, Teatralny proezd, 3, kv. 60, Belgorod; Ivan Kuzmich Silantiev, ulitsa Michurina, 63, kv. 20, Krasnoyarsk; Georgy Stepanovich Solomin, ulitsa Kutuzova, 162, kv. 53, Krasnoyarsk; Vasily Gerasimovich Mateshin, ulitsa Kutuzova, 122, kv. 6, Krasnoyarsk; Alexandr Mikhailovich Zinoviev, ulitsa Schorsa, 13, kv. 39, Krasnoyarsk; Viktor Iosifovich Shishiyannikov, ulitsa Michurina, 57, kv. 49, Krasnoyarsk; Gennady Mikhailovich Paly, ulitsa Parkovaya, 7, kv. 119, Odintsovo Moskovskoi oblasti; David Matveevich Koen, ulitsa Belomorskaya, 18, korpus 1, kv. 39, Moscow; Vladimir Vasilievich Seleverstov, ulitsa Ljusinovskaya, 53/12, kv. 21, Moscow; Jury Alexandrovich Smirnov, Teply Stan, 6 Mikroraion, korpus 113, kv. 163, Moscow, all of U.S.S.R.; Oleg

[21] Appl. No.: 724,468

[22] Filed: Sep. 20, 1976

[51] Int. Cl.[2] ..... F27D 9/00

[52] U.S. Cl. ..... 13/35

[58] Field of Search ..... 13/32, 35; 432/62; 110/99 R, 99 A

[56] References Cited

U.S. PATENT DOCUMENTS

| | | | |
|---|---|---|---|
| 1,992,465 | 2/1935 | Blagg | 13/32 X |
| 3,756,172 | 9/1973 | Brereton et al. | 13/35 X |
| 3,967,048 | 6/1976 | Longenecker | 13/35 |

FOREIGN PATENT DOCUMENTS

| | | | |
|---|---|---|---|
| 1,433,447 | 11/1971 | Fed. Rep. of Germany | 13/32 |

*Primary Examiner*—R. N. Envall, Jr.
*Attorney, Agent, or Firm*—Lackenbach, Lilling & Siegel

[57] ABSTRACT

A water-cooled roof comprises a roof ring of a circular cross section, and the ring supports a box-shaped structure welded from metal plates. The structure consists of two portions, a central portion in the form of a hollow disc and a peripheral portion in the form of a hollow ring. The joint between the central and peripheral portions is packed with a gasket of an electric-insulating material. The roof is lined with a refractory material from the side of the furnace.

The endurance of such a roof exceeds that of a conventional roof 25 - 30 times.

11 Claims, 8 Drawing Figures

WATER-COOLED ROOF OF ELECTRIC-ARC FURNACE

The present invention relates to water-cooled roofs particularly for use with electric-arc furnaces.

Since a furnace roof is subjected to considerable thermal and mechanical loads from the inside or working space side of the furnace the service life of the furnace depends to a great extent on the durability of its roof. In order to improve the endurance of the roof, the strongest-possible materials are selected.

The service life of the roofs of electric-arc furnaces made of conventional refractories (dinas bricks, magnesia-chromite, chrome-magnesite, high-alumina bricks) varies within wide limits i.e. from 25 to 300 heats.

The durability of a brick roof depends on a multitude of factors: for example, some of these factors are the geometrical dimensions of the roof proper (diameter and versed sine), the method of laying (circular sector-arc or combined type), the ratio of geometrical dimensions of the furnace (height of roof above metal surface to diameter of fusion space, the ratio of electrode "decomposition" diameter (diameter of circumference passing through the axes of electrodes) to the diameter of the fusion space, etc.); the electric arc conditions, the nomenclature of melted steels, and the transformer power, etc.

Irrespective of the mechanism of failure, the refractories in the center of the roof wear out faster than at the periphery. The service life of the furnace roof lasts usually about one calendar month.

The present day or modern stage of development of electric furnace operation is characterized by higher power fed to the furnace, reduction smelting in the ladle instead of in the furnace, and by intensive use of oxygen for blowing the metal bath, and such operations place the roof of the electric-arc furnace in still more strenuous conditions.

Accordingly, a search aimed at devising a more durable roof is well justified.

For this purpose the work is now carried out in two directions.

One of these consists in search of high quality refractory materials and improving the design of the roof brickwork.

The other direction envisages providing an artificially-cooled roof which has a space for the flow of a cooling agent.

In the first direction considerable successes have been scored. The endurance of roofs grows with the improvement in the quality of refractory materials used for laying the furnace roofs.

However, the tempo at which the quality of refractory materials is improved gets slower as the highest possible quality is approached. Hence, no further substantial increase in the endurance of the roof brickwork can be attained by working in said first direction.

Obviously, this is the reason why in recent times close attention has been given to the second direction of thought which tends to create artificially-cooled electric-arc furnaces.

The designs of the artificially-cooled roofs can be divided into two groups, viz., tubular and box-shaped.

The tubular designs feature coils of steel pipes with a cooling agent circulating inside. From the side of the furnace the roof is provided with heat insulation made of refractory bricks or another suitable refractory mass.

Such a roof can withstand 350 heats whereas the roof of high-alumina bricks 225 mm thick can only withstand 26 heats.

However, operation of the furnace with such a roof presents considerable difficulties. The central portion of the roof is liable to wear out sooner because it is subjected to heavier thermal loads than the peripheral portion.

Besides, the central portion is influenced electrically by the electrodes.

As the roof is made solid, and cannot be dismantled, failure of its central portion calls for replacing the entire roof. In addition, even a short-term failure of coolant supply to the pipes creates an emergency situation leading to a probable burnout of the roof.

The furnace requires to be periodically gunited at the lower side of the roof in the course of operation.

The manufacturer of pipe coils involves considerable difficulties since it calls for the use of additional equipment and personnel.

There have been attempts at devising a composite roof wherein the central portion has a box-shaped space for the coolant and the peripheral portion consists of pipes.

Apparently, such a roof is more durable since its central portion is cooled better than in the tubular roofs (see Author's Certificate No. 214560, USSR).

However, these roofs are also not readily dismountable so that wear of an individual portion thereof calls for replacing the entire roof.

Besides, these roofs are characterized by considerable power losses for magnetic reversal and considerable losses of heat transferred to cooling water.

An example of a box-shaped roof is covered by the Author's Certificate No. 365538, USSR.

This water-cooled roof for the electric-arc furnace is of an integral type made of metal plates, is provided with a roof ring of a rectangular cross section and is lined with a refractory material on the interior side or the side of the furnace space.

The roof has a space for the passage of coolant and through holes or other suitable apertures for the electrodes, for the delivery of gas into the furnace and for the evacuation of smoke or other waste gases.

This roof is more reliable in operation and more durable than the other known roofs of electric-arc furnaces.

However, this roof is noted for considerable heat losses and losses of power for magnetic reversal. In addition, reliability of this roof is impaired by a large number of fillet welds.

The growing demand for metal and the need for improving its production technology have posed a problem of extending the operating period of electric-arc furnaces by increasing the service life of their roofs.

The main object of the present invention is to provide a water-cooled roof of an electric-arc furnace so as to extend considerably the service life of the furnace.

Another object of the present invention is to reduce the number of fillet welds required in making the roof ring.

Still another object of the present invention is to speed up replacement of the central portion of the roof which is subjected to the heaviest thermal loads from the side of the furnace space.

This problem has been solved by providing a water-cooled roof of an electric-arc furnace comprising a roof ring which supports a box-shaped structure made of metal plates and is provided with through holes for accommodating the electrodes and for the delivery of gas into the furnace and discharging the gaseous products. Also, a refractory lining is provided at the side of the furnace space, the roof ring has a substantially circular cross section and said welded box-shaped structure is made of a central portion in the form of a hollow disc and a peripheral portion in the form of a hollow ring, and the central portion rests on the peripheral portion through a circular gasket of an electric-insulating material.

The circular cross section of the roof ring reduces considerably the number of fillet welds thereby increasing the service life of the roof ring and, consequently of the roof and furnace.

The central portion of the roof is liable to wear out faster because it stands considerable thermal loads and electrical discharges. The roof made of removable sections simplifies and speeds up the replacement of the central portion of the roof and increases the endurance of the roof.

It is expedient that the central portion of the roof should consist of three sectors electrically insulated from one another and should have a header whose inlet is connected to the roof ring and the outlets are connected to each of said sectors and to the peripheral portion of the roof.

Such a design of the central portion of the roof rules out electric discharges from the electrode to the metal parts of the water-cooled roof and reduces the losses of power for magnetic reversal.

Besides, the provision of a header reduces to a minimum the number of lines delivering cooling water to the individual parts of the roof.

It is desirable that each sector of the central portion in the water-cooled roof should have a cutout extending from the side wall of the sector to the hole for the electrode.

Such cutouts in the sectors of the central portion of the roof will reduce the losses of power for magnetic reversal.

It is preferable that the central and peripheral portions of the roof be provided with vertical channels to receive cups with flanges for connection to the gas delivery pipes and that the side wall of each cup should have through holes in its lower part so that the longitudinal axes of said holes should be set at an angle of 70° - 75° to the longitudinal axis of the cup.

The provision of channels with cups of this design in the roof makes it possible to deliver gas to the heat-receiving surface of the roof from the side of the furnace space.

The delivery of gas during the reduction period of metal melting when there is practically no oxygen in the furnace and the temperature of gases reach 1500° - 1700° C causes decomposition of gases accompanied by liberation of sooty carbon. The layer of gases containing sooty carbon weakens the heat flow from the molten metal bath to the roof.

During the other melting periods said cups can be used for the delivery of a gas-air mixture thus burning the gas near the roof surface and reducing the losses of heat from the working space of the furnace.

It is possible in the central and/or peripheral portions of the roof to butt-weld the upper metal plate to the upper end face of the side wall and the lower metal plate to the lower end face of the same wall.

Such a joint between the wall and the upper and lower metal plates in each portion of the roof makes it possible to dispense with the fillet welds, to make the roof strong and prolong its service life. In this case the shape of the side walls in cross section approaches an arc or a channel.

It is desirable that the lower metal plates in the central and peripheral portions of the roof be provided over their entire outside area with metal strips welded edge-on so that they form a number of cells which would be filled with a refractory material.

Such a strengthening of the lower roof surface adds to its reliability and avoids the collapse of the lining in the course of furnace operation.

It is preferable to make through holes in said metal strips at the points forming the cell walls, and to pass wire through said holes.

The wire inside the cells provides additional strengthening thus improving the adhesion of the lining to the lower surface of the roof.

Now the invention will be described in detail by way of examples of a water-cooled roof of an electric-arc furnace with reference to the accompanying drawings in which.

Figure 1:
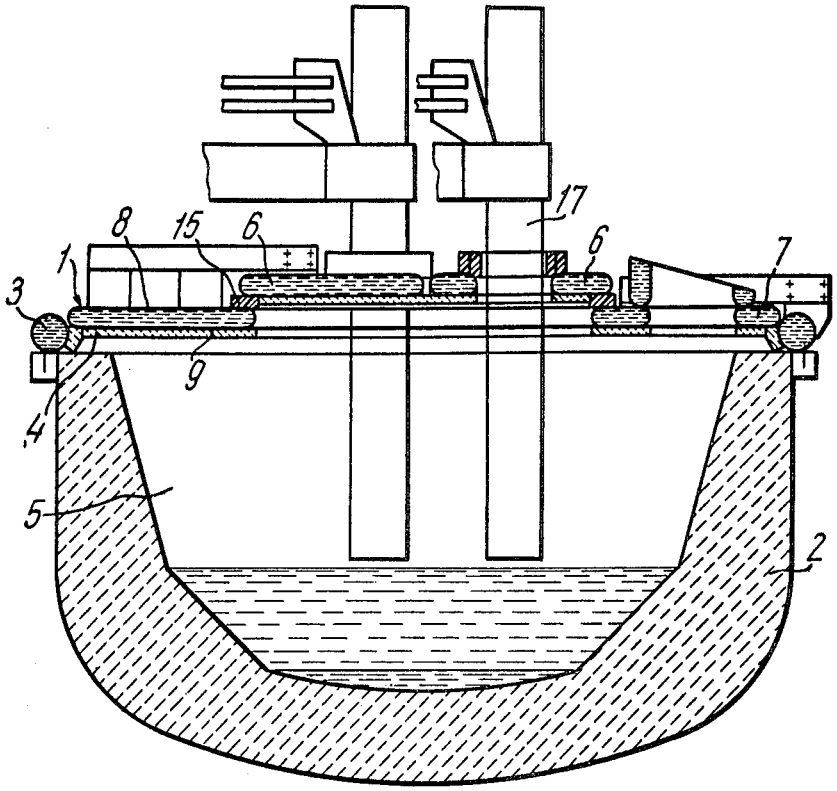
FIG. 1 is a longitudinal section of a furnace with a water-cooled roof according to the invention.

The water-cooled roof 1 (FIG. 1) for an electric-arc furnace 2 has the form of a welded box-shaped metal structure resting on a roof ring 3 and is provided with a lining 4 made of a refractory material on the side of the furnace facing the interior or space 5. The box-shaped structure consists of a central portion 6 (FIG. 2) in the form of a hollow disc and a circular peripheral portion 7 in the form of a hollow ring.

Figure 2:
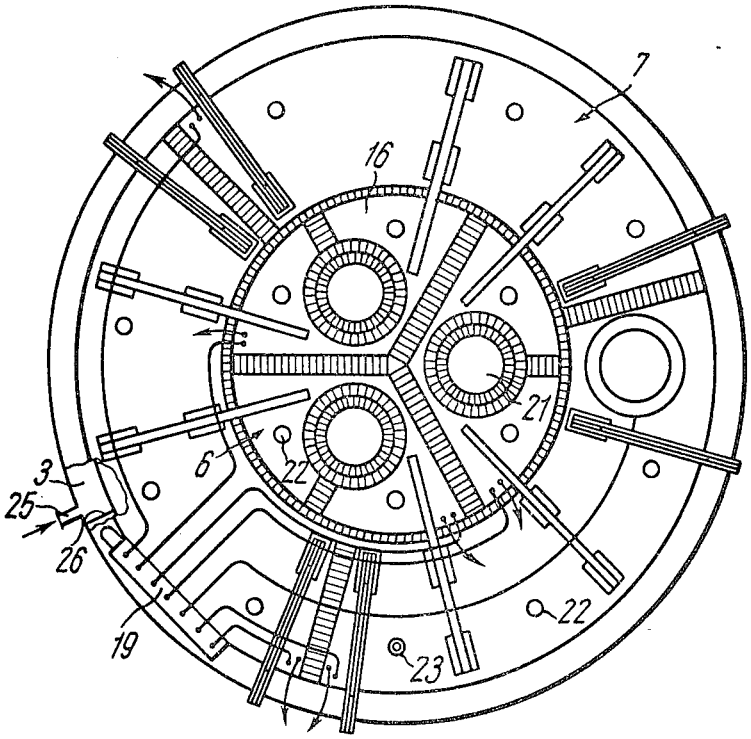
FIG. 2 is a plan view of the water-cooled roof with sectors, and with a partial cutout portion showing a part of the roof ring and the cooling pipe connection.
Figure 3:
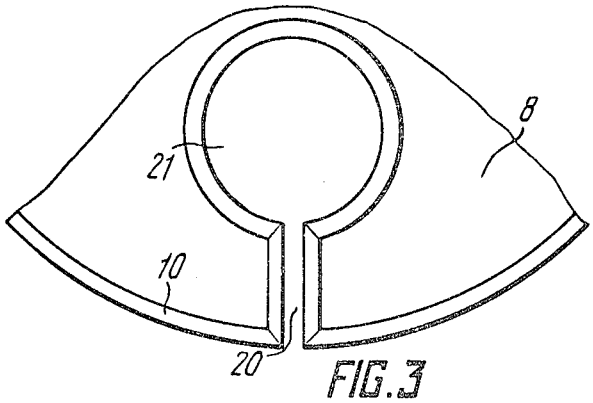
FIG. 3 is a fragmentary top view of a portion of a sector of the central portion of the roof with a cutout at its side wall.
Figure 4:
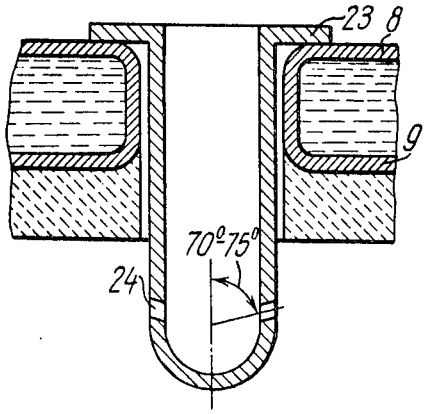
FIG. 4 is a longitudinal sectional view through a portion of the water-cooled roof with a through channel for the cup connected to a gas line.
Figure 5:
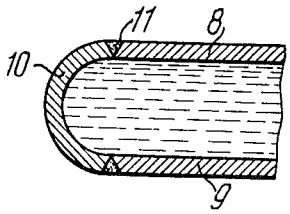
FIG. 5 illustrates in section a part of the roof, a butt joint and an arc-shaped side wall.
Figure 6:
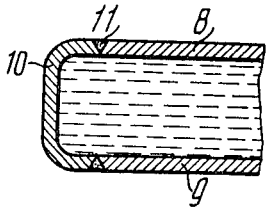
FIG. 6 illustrates in section a part of the roof, a butt joint and a channel-shaped side wall.

The roof portions 6 and 7 are made of pairs of metal plates 8 and 9 (respectively, FIG. 3 and FIG. 4) which form the upper and lower sides of these portions, respectively. The end faces of the side walls 10 (FIGS. 5,6) of each roof portion 6 and 7 (FIG. 2) are connected by a butt weld 11 (FIGS. 5,6) with the corresponding upper 8 and lower 9 metal plates which form the upper and lower sides of the roof. Such a joint is sufficiently reliable in operation, as the strength and durability of the butt weld 11 itself is not inferior to the corresponding properties the metal from which the welded plates 8 and 9 are made.

Besides, the side wall 10 can have various cross sections, for example, an arc or channel which enable reduction in the number of welds which is highly important. Also, one may replace the fillet welds by the more reliable butt welds.

Figure 7:
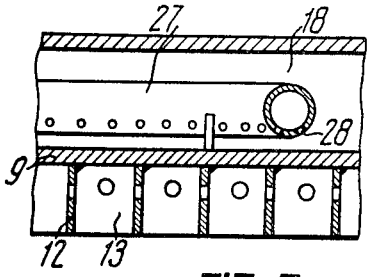
FIG. 7 illustrates a fragmentary vertical sectional view through a part of the water-cooled roof with cells formed by metal strips.

To provide for reliable fastening of the lining 4 (FIG. 1), the lower metal plates 9 (FIG. 7) are reinforced by metal strips 12 which are welded edge-on and form rows of cells 13 over the entire area of the roof 1 (FIG. 1) facing the interior space 5 of the furnace 2.

At points where the metal strips 12 (FIG. 7) form the walls of the cells 13, through holes 30 for passing the wire 14 (FIG. 8) are provided. These cells 13 are filled with a refractory material which serves as lining 4 (FIG. 1). The joint between the central and peripheral portions, 6 and 7 respectively of the roof 1 is packed with a circular gasket 15 of an electric-insulating material.

Inasmuch as the central portion 6 of the roof 1 is subjected to heavier wear, it is made removable and can be easily and simply replaced. The central portion 6 is installed on the circular peripheral portion 7 so that it overlaps its hole; the peripheral portion 7, in turn, rests on the roof ring 3 which is of a circular cross section. This cross section of the roof ring 3 allows for a reduction in the number of welds during its manufacture and increases its operational reliability.

The roof 1 can also be made with the central portion 6 consisting of three sectors 16 (FIG. 2) electrically-insulated from one another. This averts electrical discharges from the electrode 17 (FIG. 1) to the metal parts of the roof 1 and reduces losses of power for magnetic reversal.

Each portion 6 and 7 of the roof 1 has a space 18 (FIG. 7) for the passage of the cooling agent, e.g. water, delivered from a water supply system (not shown in the drawing).

The cooling water is distributed to the portions 6 and 7 of the roof 1 by a header 19 (FIG. 2) whose inlet is connected to the roof ring 3 and the outlets are connected to each of said sectors 16 and to the circular peripheral portion 7 of the roof 1.

Each sector 16 of the central portion 6 of the roof 1 has a cutout 20 (FIG. 3) extending from the side wall 10 of the sector 16 to the hole 21 for the electrode 17 (FIG. 1). These cutouts 20 (FIG. 3) in the sectors 16 (FIG. 2) of the central portion 6 of the roof 1 also aid in reducing the losses of power for magnetic reversal.

Besides, the central and peripheral portions (6 and 7, respectively) the roof are provided with through channels 22 for the accommodation of cups 23 (FIG. 4) with flanges for connection to the gas delivery pipes (not shown in the drawing). The lower part of the side wall of each cup 23 is provided with through holes 24 forgas discharge; the longitudinal axes of said cups form an angle of 70° - 75° with the longitudinal axis of the holes 24. Said holes 24 ensure delivery of gas to the heat-receiving surface of the roof 1 (FIG. 1) from the interior space 5 of the furnace 2 and create a screening layer of gas which reduces the heat losses of the furnace 2 through its metal water-cooled roof 1.

Erection of the roof 1 commences with installation of the circular peripheral portion 7 of the roof together with installation of the roof ring 3 on the furnace 2. In view of the fact that the outside diameter of the central portion 6 of the roof 1 is larger than the inside diameter of the through hole in the circular peripheral portion 7, alignment of the electrodes 17 is accomplished accurately and quickly.

The cooling water is delivered to the roof 1 through a pipe connection 25 (FIGS. 1,2) and passes around the perimeter of the roof ring 3 to the dividing wall 26 wherefrom it flows into the header 19 and is distributed to the sectors of the central and peripheral portions 6 and 7 of the roof through pipes and hoses (not shown in the drawings). The space 18 (FIG. 7) of the roof is provided with embedded pipes 27 with holes 28 which direct the streams of water onto the inner side of the heat-receiving surface of the roof.

Inasmuch as the entire amount of water required for operation of the roof passes through the roof ring 3 (FIG. 1), said water flows through said ring at a high velocity which ensures efficient transfer of heat received by the surface of the roof ring 3 from the working space 5 of the furnace 2.

The arrangement of the central portion 6 of the roof above the peripheral portion 7 provides for uniform distribution of thermal loads over the surface of the roof 1 in the course of furnace operation and, consequently, uniform operating conditions of the lining 4.

The refractory lining 4 (e.g. refractory concrete) is applied to the reinforced surface of the lower side 9 (FIG. 7) of the roof. The metal strips 12 are welded by a continuous weld to the heat-receiving surface of the lower plates 9 so they they form cells 13 up to 40 - 45 mm deep.

Figure 8:
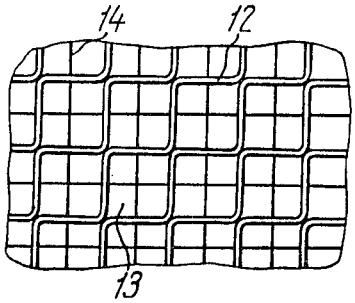
FIG. 8 is a fragmentary bottom view of the roof portion shown in FIG. 7.

The walls of the cells 13 are provided with holes 30 located 20 mm from the cooled surface and they are intended for the passage of the wire 14 (FIG. 8). Such wire or reinforcement metal prevents the packed or run-in mass from falling out before the furnace has been put in operation. In the course of operation the packing wears out. The vapours of metal and slag produced in the zone of the arc are condensed on the packing surface and being acted upon by the capillary forces, rise to the cooled surface. Besides, the packing surface is covered with splashes of metal and slag which are produced, for example, during blowing of metal with oxygen. This forms a crust of slag on the packing which protects its remaining part from further wear. The thickness (and thermal resistance) of the slag crust depend on the temperature conditions of the furnace and are set spontaneously so that the amount of heat received by the roof surface from the working space of the furnace is transferred by the cooling water.

The roof is cooled with recycled water.

The gas is delivered from the gas line through a regulating element to the cups 23 (FIG. 4) whose holes are arranged so as to direct the gas onto the heat-receiving surface of the roof.

The number of the cups 23 and their arrangement on the roof surface are selected so as to cover the entire lined surface of the roof 1 with a layer of shielding gas.

During the reduction period of metal melting the cups 23 receive the gas which is decomposed at a high temperature without oxygen (this being the condition of the reduction period of metal melting) and produce sooty particles.

The layer of gases containing sooty particles reduces the losses of heat through the water-cooled roof.

In the course of the other melting periods, the cups 23 deliver a gas-air mixture which burns up near the surface of the roof 1 at the side of the space 5 (FIG. 1) of the furnace 2 and also reduce the losses of heat from the working space of the furnace 2.

The tests of the roof according to the invention have proved that its endurance amounts to 6500 heats against 240 heats obtained with a conventional magnesia-chromite roof 225 mm thick. The consumption of electrodes has dropped from 5.3 to 4.3 kg/t of steel.

The pressuretightness of the furnace has also been improved which is particularly important for vacuum furnaces. Besides, the consumption of alloying elements during melting of stainless steel grades has also decreased. The idle time of the furnace has diminished and the labor expenditures for making brick roofs have been eliminated.

We claim:

1. A water-cooled roof for an electric-arc furnace comprising: a hollow roof ring of a circular cross-section disposed adjacent the top wall portion of said furnace; a roof structure having side walls and a central hollow, disc portion and a circular, hollow peripheral ring portion, said central portion bearing through a circular gasket of an electric-insulating material on said peripheral ring portion which in turn bears on said roof ring; at least said central portion being provided with at least one through hole for the electrode of said furnace and at least said peripheral ring portion being provided with holes for the delivery of gases into the furnace and discharging gaseous products; a refractory lining applied to the surfaces of said roof ring and said roof structure facing the interior side of the furnace space; and said roof ring, said central portion and said peripheral ring portion being in fluid flow connection with each other for circulating cooling water throughout said water-cooled roof.

2. A water-cooled roof according to claim 1, wherein said central portion comprises three sectors electrically insulated from one another and said water-cooled roof including a header having an inlet connected to said roof ring and having outlets connected to each of said sectors and to said peripheral ring portion.

3. A water-cooled roof according to claim 2, wherein each sector of aid central portion has a cutout extending from the side wall of the sector to said holes for said electrode.

4. A water-cooled roof according to claim 1, wherein said central and peripheral portions of the roof are provided with vertical passages to accommodate flanged cups for connection to gas-delivery pipes, the lower part of the side wall of each cup having through holes whose longitudinal axes are set at an angle of 70°–75° to the longitudinal axis of the cup.

5. A water-cooled roof according to claim 1, wherein said roof structure is a box-shaped structure formed of welded metal plates, and wherein both said central and peripheral ring portions are formed by pairs of metal plates butt-welded to the upper end-face of the side wall and to the lower end-face of the same wall.

6. A water-cooled roof according to claim 5, wherein in said central and peripheral ring portions, the lower of said pairs of metal plates are provided over their entire outside area with metal strips welded along their end edges so that said strips form walls defining rows of cells which are filled with said refractory lining.

7. A water-cooled roof according to claim 6, wherein said strips have through holes at the points forming the cell walls, and said holes serving for the passage of wire which aids in holding said refractory lining to said rows of cells.

8. The water-cooled roof according to claim 1, wherein said central portion is removably mounted so as to facilitate replacement.

9. The water-cooled roof according to claim 1, wherein said central portion is positioned generally in a concentric manner on said circular peripheral ring portion, and the latter in turn rests on said roof ring of said furnace.

10. The water-cooled roof according to claim 1, wherein each of said central and peripheral ring portions of said roof are provided with a space for the passage of the coolant agent or water.

11. The water-cooled roof according to claim 10, wherein said spaces are provided with pipes mounted therein having apertures which direct a cooling spray onto the side of the roof surface facing away from the interior side of the furnace space, and said pipes being in fluid flow connection with said roof ring.

* * * * *